US006619279B1

(12) United States Patent
Liao

(10) Patent No.: US 6,619,279 B1
(45) Date of Patent: Sep. 16, 2003

(54) BROILER SWITCH STRUCTURE

(76) Inventor: Tsung-Ming Liao, 2-8 South North One Rd., Tah Cha Township, Taichung Hsien (TW)

( * ) Notice: Subject to any disclaimer, the term of this patent is extended or adjusted under 35 U.S.C. 154(b) by 68 days.

(21) Appl. No.: 10/043,963

(22) Filed: Jan. 14, 2002

(51) Int. Cl.[7] ..... F24C 3/08
(52) U.S. Cl. ..... 126/39 N; 431/343
(58) Field of Search ..... 126/39 N, 39 B, 126/39 L, 41 R; 431/343; 137/883, 875

(56) References Cited

U.S. PATENT DOCUMENTS 1,915,823 A * 6/1933 Hall ..... 431/343
2,580,939 A * 1/1952 Meriam ..... 126/39 N
2,655,912 A * 10/1953 Kennedy ..... 126/39 N
2,782,779 A * 2/1957 Chambers ..... 126/39 H
2,907,317 A * 10/1959 Chambers ..... 126/41 R
4,805,587 A * 2/1989 Schweitzer ..... 126/39 L
6,202,639 B1 * 3/2001 Wu ..... 126/39 N

FOREIGN PATENT DOCUMENTS

EP 0 926 437 A1 * 6/1999 ..... F24C/3/08

* cited by examiner

*Primary Examiner*—Henry Bennett
*Assistant Examiner*—Josiah C. Cocks
(74) *Attorney, Agent, or Firm*—Harrison & Egbert

(57) ABSTRACT

A broiler switch structure includes a main burner and an adjustment control switch connected with the main burner. The adjustment control switch has a main body, and a pilot light generator which is provided with a connection body and a pilot light head. An adjustment knob is fastened pivotally to the main body of the adjustment control switch. The adjustment control switch is provided with an angle adjustment member enabling the switch structure to fit the broiler shells of various forms.

1 Claim, 12 Drawing Sheets

BROILER SWITCH STRUCTURE

RELATED U.S. APPLICATIONS

Not applicable.

STATEMENT REGARDING FEDERALLY SPONSORED RESEARCH OR DEVELOPMENT

Not applicable.

REFERENCE TO MICROFICHE APPENDIX

Not applicable.

FIELD OF THE INVENTION

The present invention relates generally to a broiler, and more particularly to a switch structure of the broiler.

BACKGROUND OF THE INVENTION

As shown in FIG. 1, a prior art broiler comprises a housing 10 in which a main burner 11 and a pilot burner switch 12 are disposed such that the main burner 11 is connected to a gas pipe, and that the main burner 11 and the pilot burner switch 12 are fastened together at a fixed angle. In light of the main burner 11 and the pilot burner switch 12 being fastened together at the fixed angle, they are not compatible with the housing 10 of various specifications.

BRIEF SUMMARY OF THE INVENTION

The primary objective of the present invention is to provide a broiler switch structure which is compatible with a variety of broiler shells different in profile from one another.

In keeping with the principle of the present invention, the foregoing objective of the present invention is attained by a broiler switch structure comprising a main burner which is fastened with an adjustment control switch. The adjustment control switch is provided with an angle adjustment member and a pilot burner. The angle adjustment member is formed of a connection main body, a gas connection pipe, a pilot adjustment rod, and a fastening frame.

The features and the advantages of the present invention will be more readily understood upon a thoughtful deliberation of the following detailed description of the present invention with reference to the accompanying drawings.

DETAILED DESCRIPTION OF THE INVENTION

Figure 1:
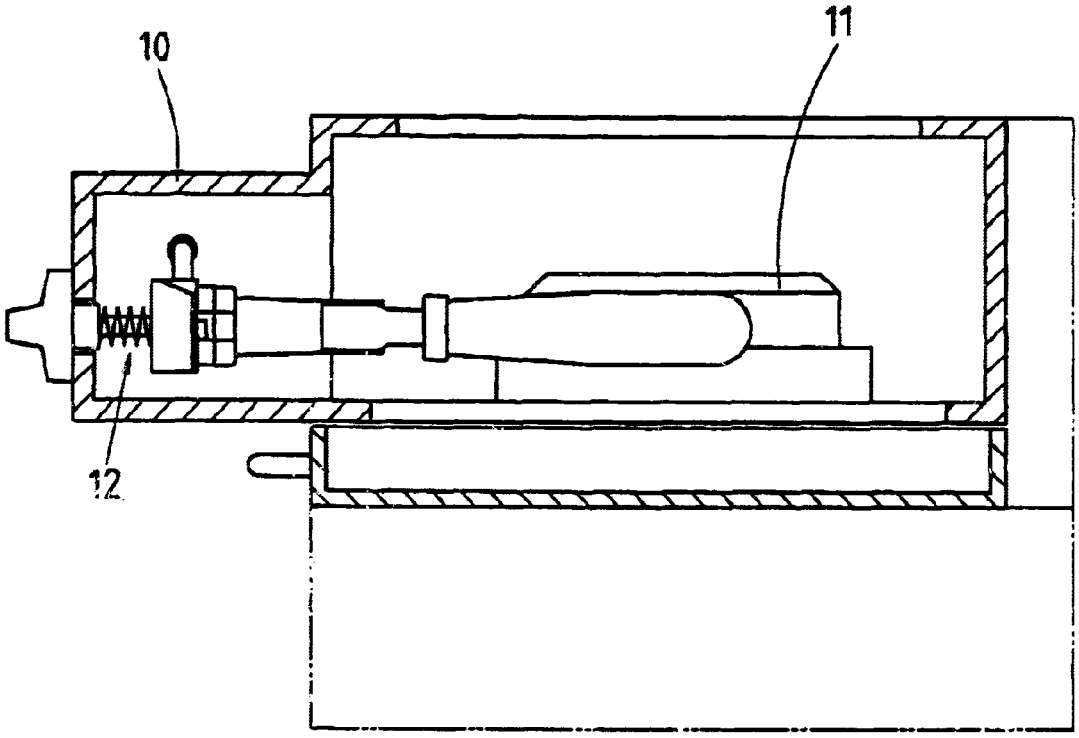
FIG.1 PRIOR ART
FIG. 1 shows a schematic view of a broiler of the prior art.
Figure 2:
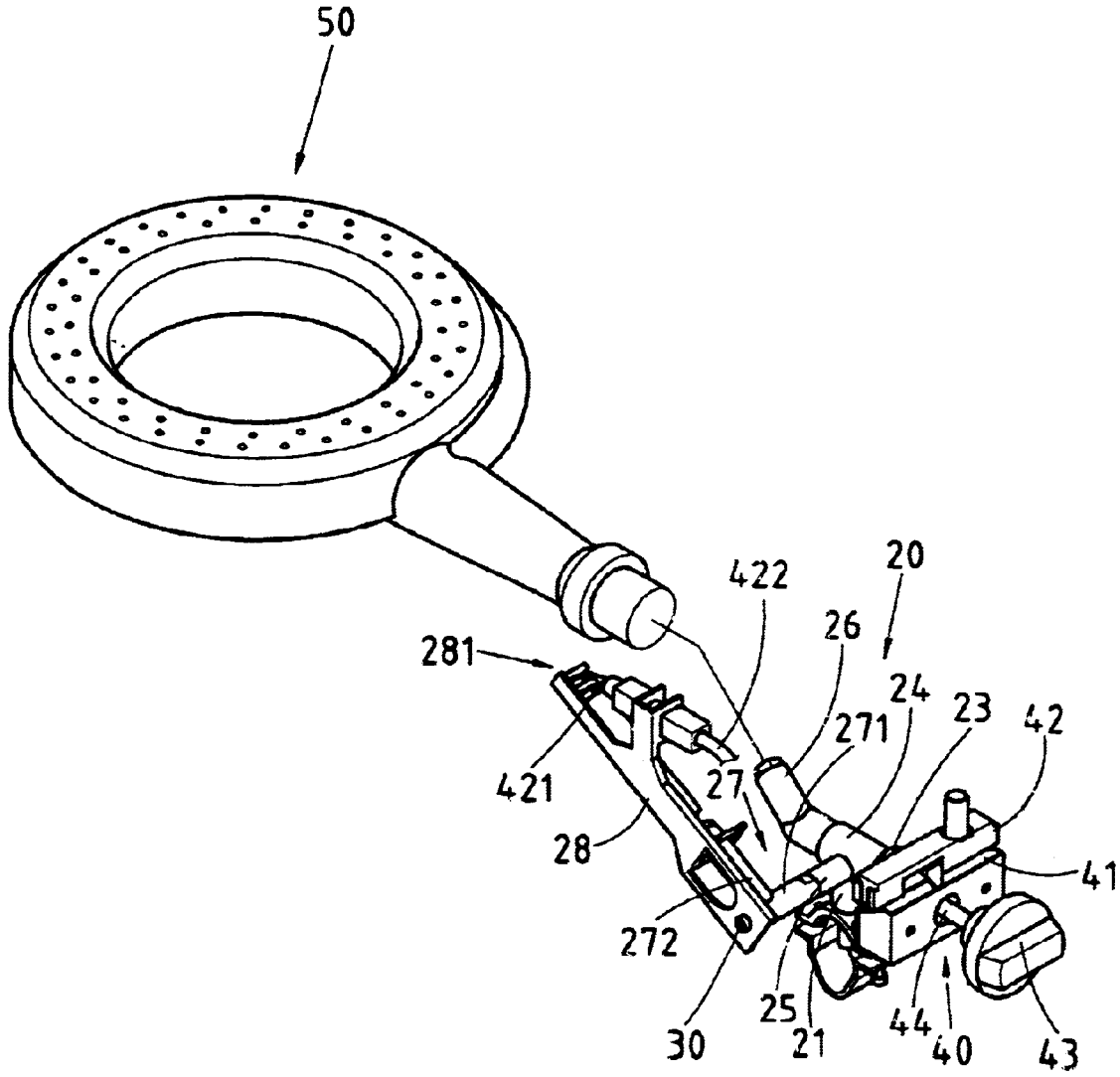
FIG. 2 shows a perspective view of the present invention.
Figure 3:
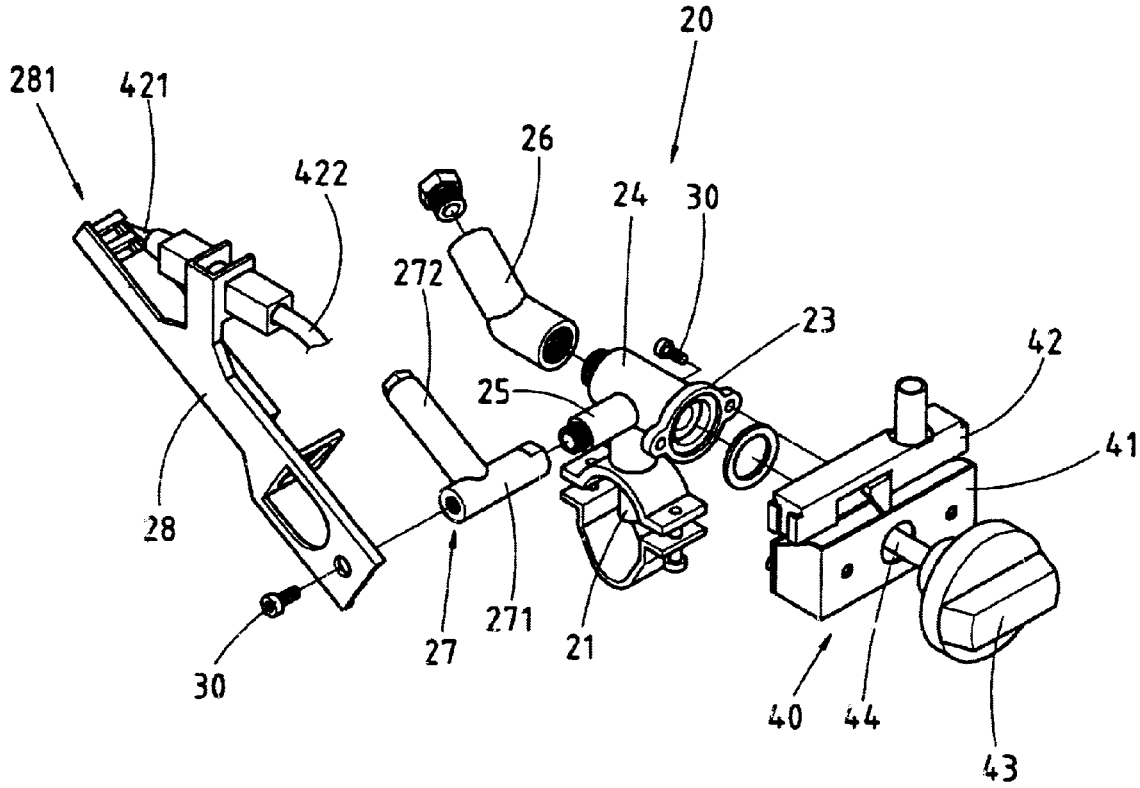
FIG. 3 shows an exploded view of the present invention.
Figure 4:
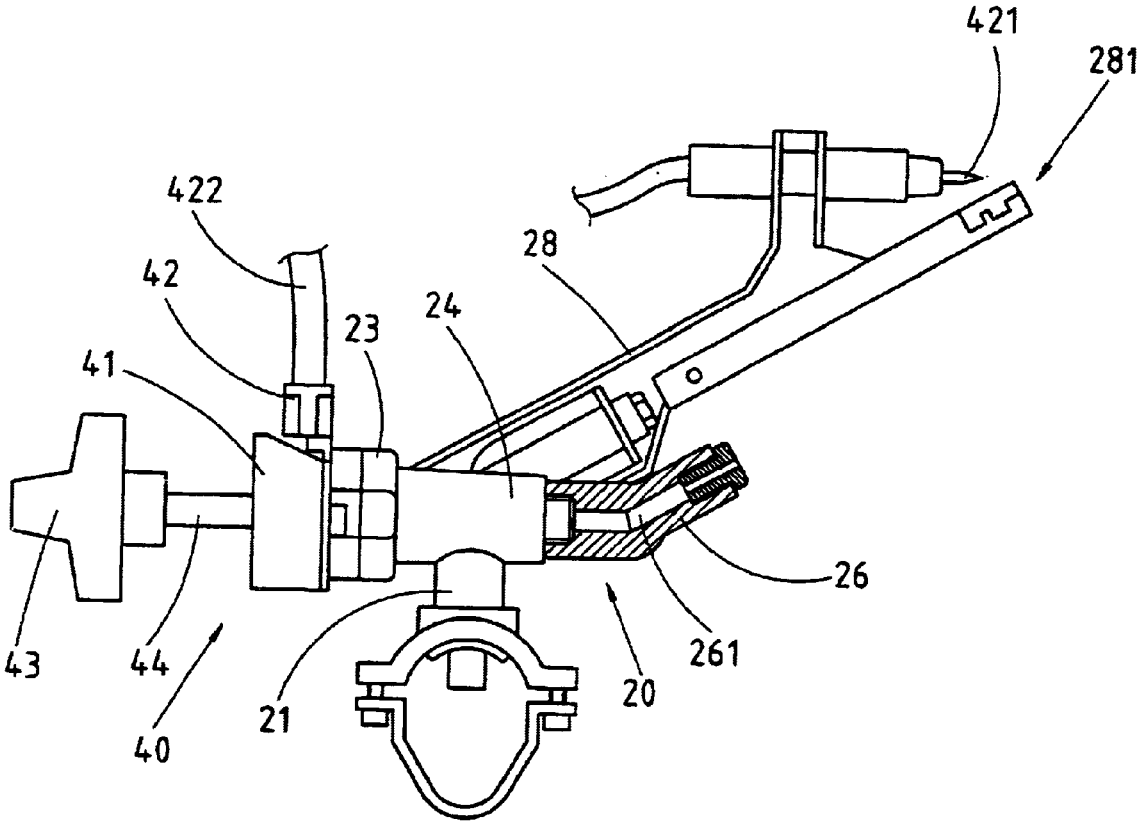
FIG. 4 shows a sectional view of the present invention.
Figure 5:
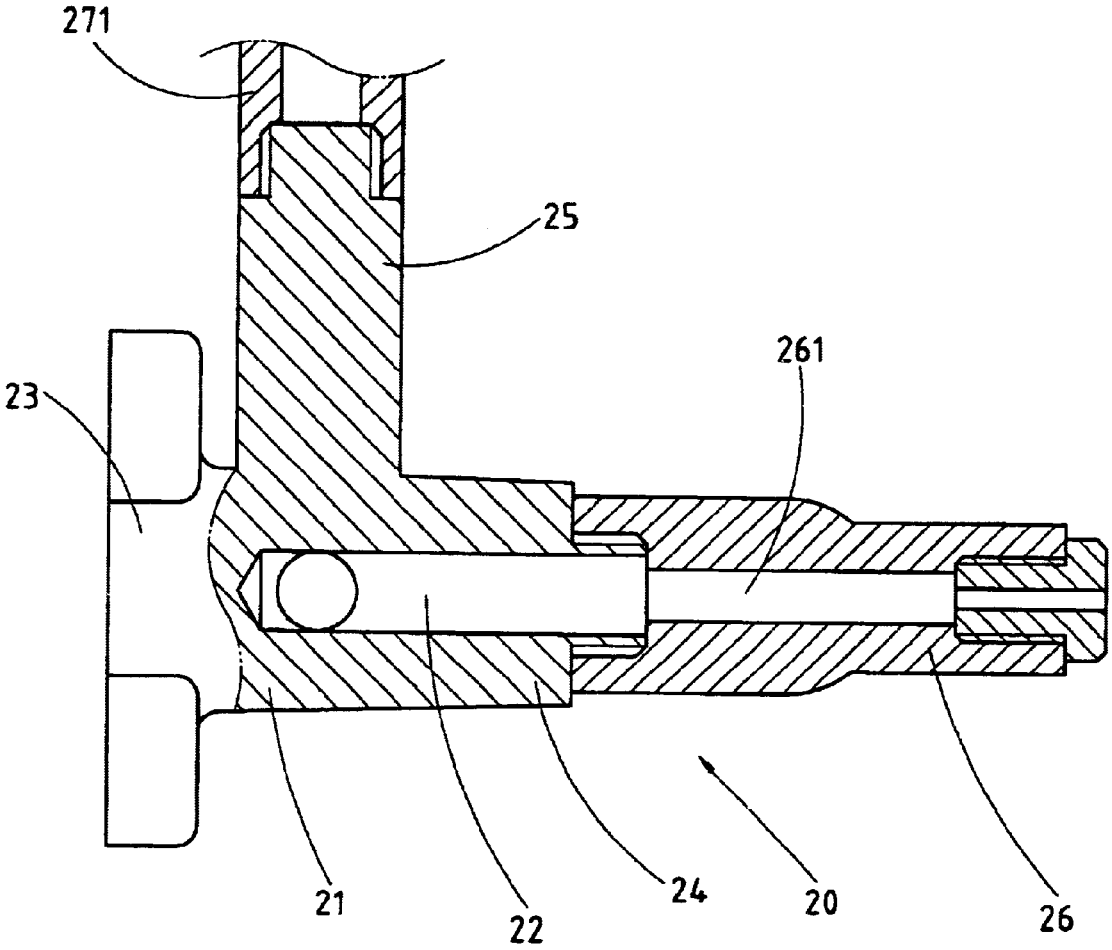
FIG. 5 shows another sectional view of the present invention.
Figure 6:
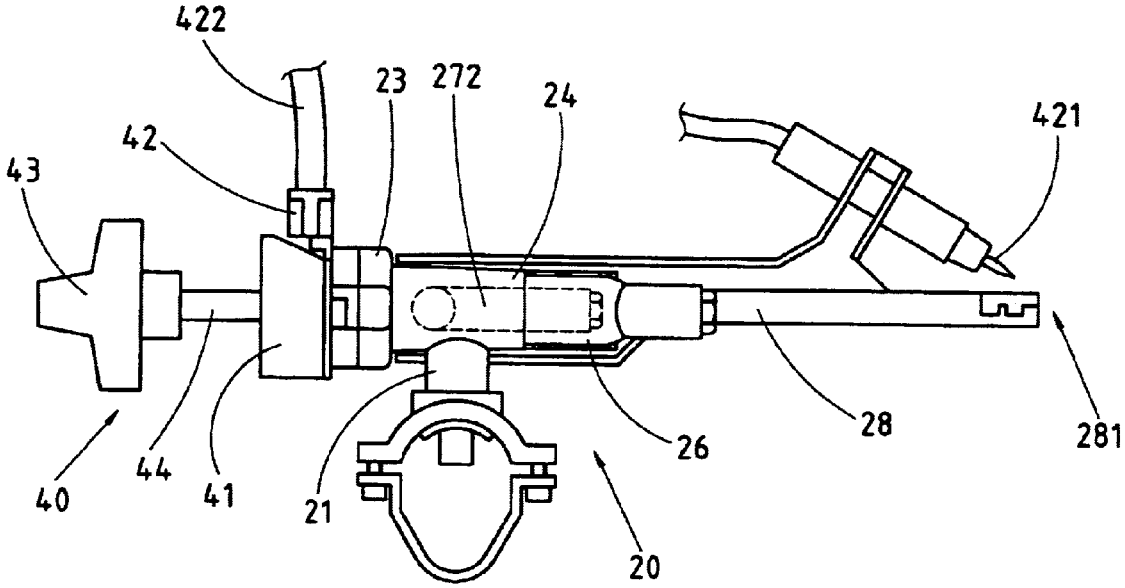
FIG. 6 shows a schematic view of a first embodiment of the present invention.
Figure 7:
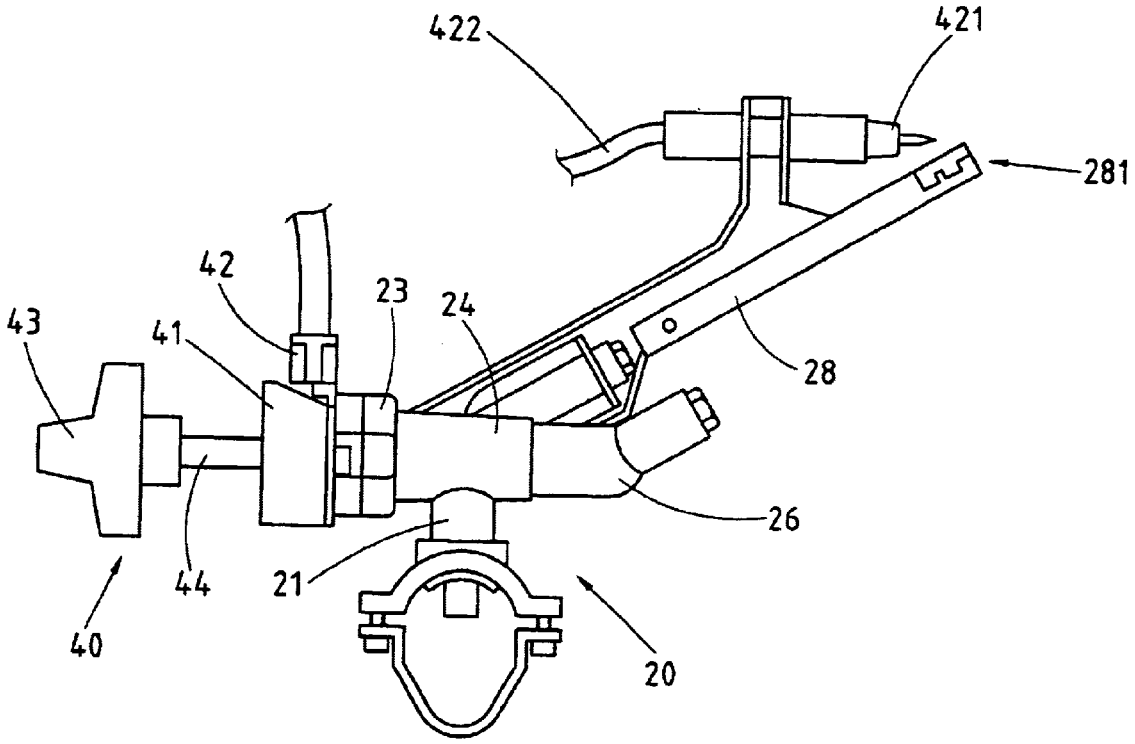
FIG. 7 shows a schematic view of a second embodiment of the present invention.
Figure 8:
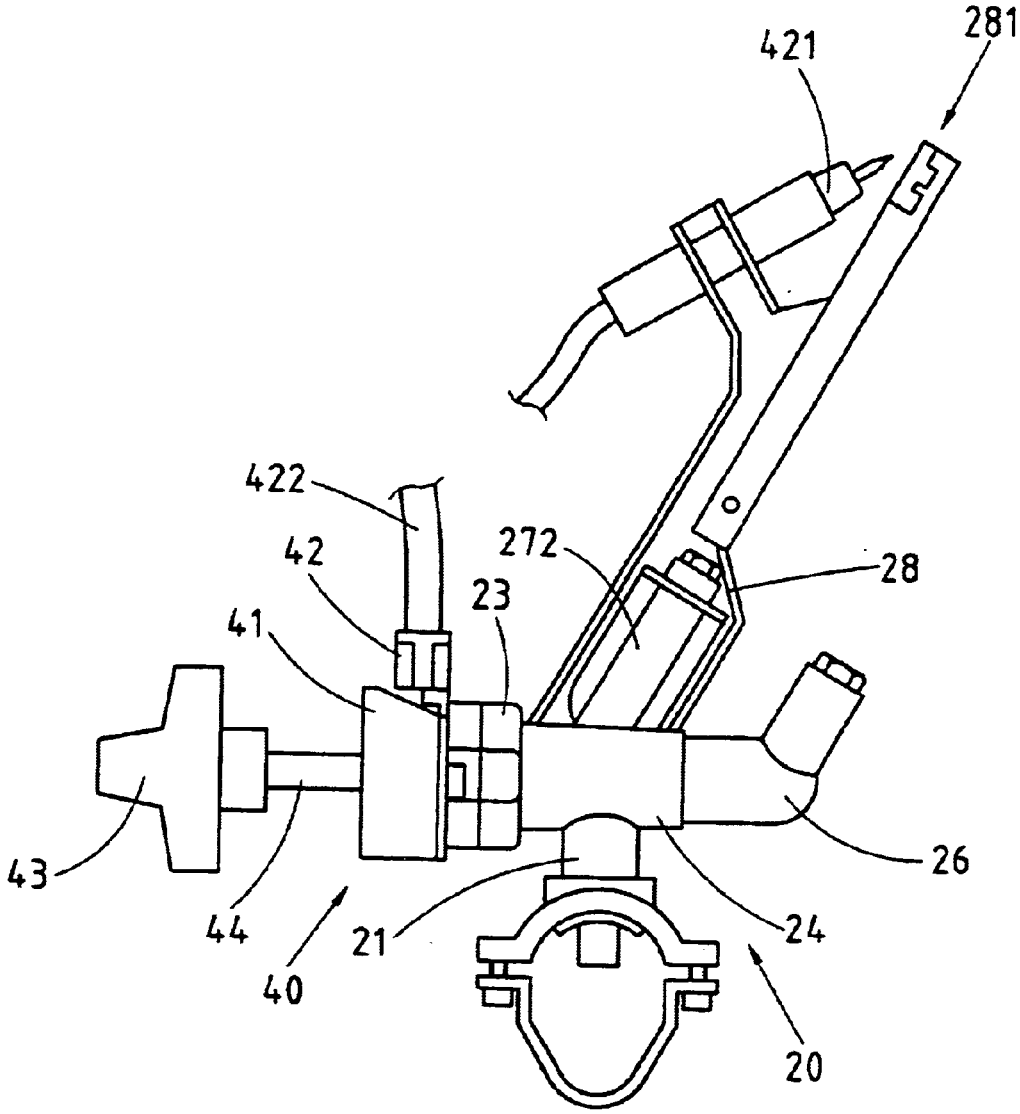
FIG. 8 shows a schematic view of a third embodiment of the present invention.
Figure 9:
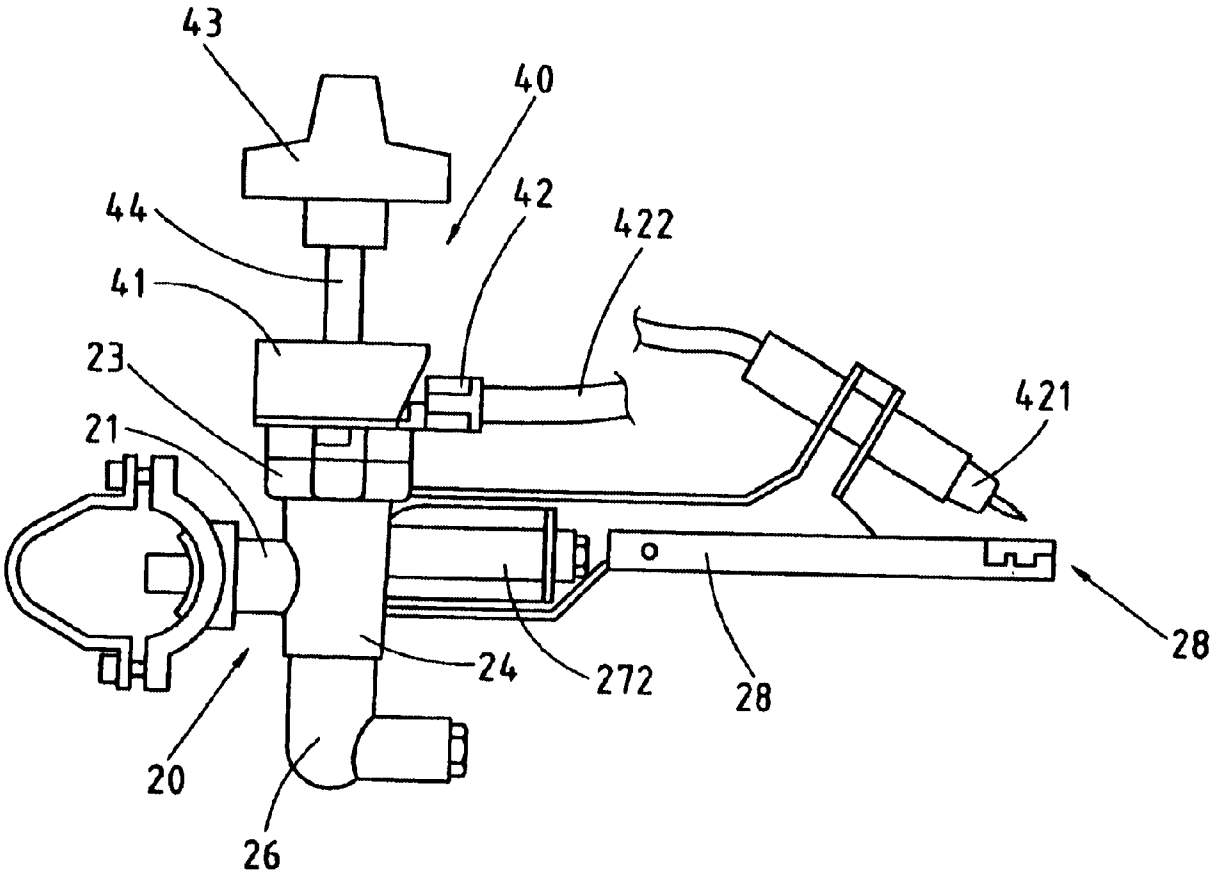
FIG. 9 shows a schematic view of a fourth embodiment of the present invention.

As shown in FIGS. 2–9, a broiler switch structure embodied in the present invention comprises a main burner 50, and an adjustment control switch 40 which is provided with an angle adjustment member 20. The adjustment control switch 40 has a main body 41 on which a pilot light generator 42 is mounted. The pilot light generator 42 is provided with a connection body 422 and a head 421 extending from the connection body 422. An adjustment knob 43 is fastened with a pivoting rod 44 which is pivoted to the interior of the main body 41.

The pilot light generator 42 is triggered by the adjustment knob 43 such that the pilot light is transmitted to the head 421 via the connection body 422.

The angle adjustment member 20 is formed of a connection main body 21, a gas connection pipe 26, a pilot light adjustment rod 27, and a fastening frame 28.

The connection main body 21 is provided in the interior with a gas duct 22 and is further provided with a plurality of connection ends 23, 24 and 25, which are fastened with the adjustment control switch 40 by a fastening bolt 30.

The gas connection pipe 26 is provided in the interior with a channel 261 and is connected at one end with the second connection end 24 of the connection main body 21 such that the channel 261 is in communication with the gas duct 22 of the connection main body 21.

The pilot light adjustment rod 27 is formed of a first rod body 271 and a second rod body 272, which are connected at an angle such that the first rod body 271 is fastened at one end with the third connection end 25 of the connection main body 21.

The fastening frame 28 is fastened at one end to the first rod body 271 of the pilot light adjustment rod 27 by a fastening bolt 30, and at the other end 281 with the head 421 of the pilot light generator 42.

The gas connection pipe 26 can be fastened with the second connection end 24 of the connection main body 21 at a desired angle, as illustrated in FIGS. 6, 7, 8, and 9.

Figure 10:
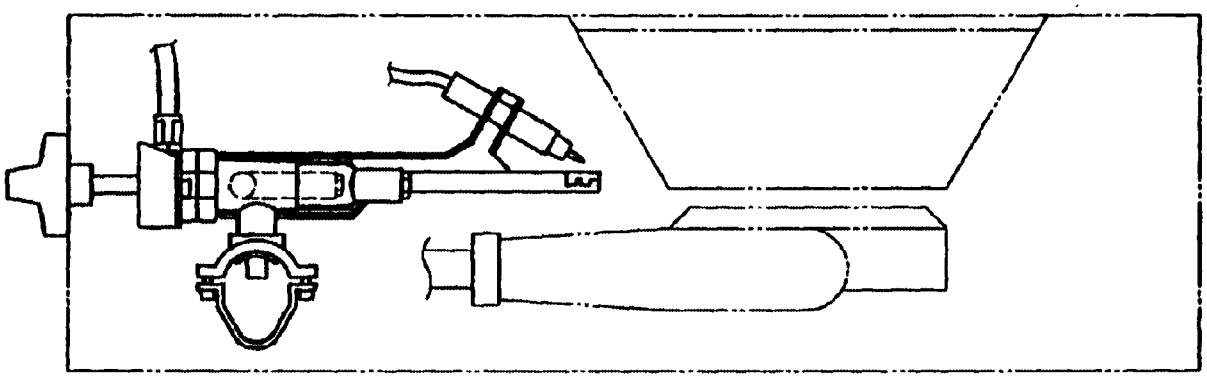
FIG. 10 shows a first reference diagram of the present invention in use.
Figure 11:
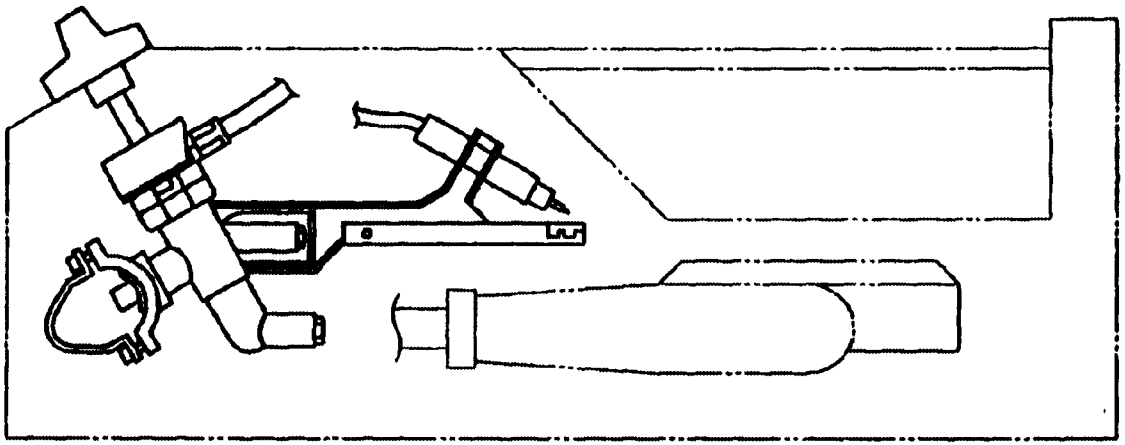
FIG. 11 shows a second reference diagram of the present invention in use.
Figure 12:
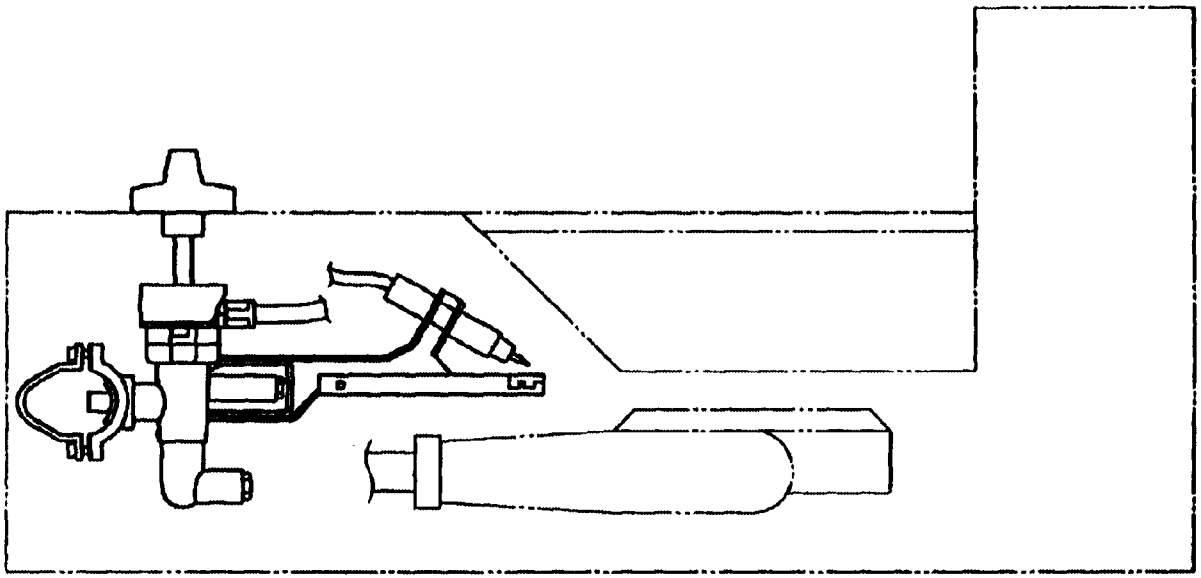
FIG. 12 shows a third reference diagram of the present invent in use.

The pilot light adjustment rod 27 is fastened with the third connection end 25 of the connection main body 21 in conjunction with the fastening frame 28, so as to fit the broiler shells of various forms, as illustrated in FIGS. 10, 11, and 12.

I claim:

1. A broiler switch structure comprising:

a main burner; and an adjustment control switch connected with said main burner and comprised of an angle adjustment member, said adjustment control switch comprising a main body and a pilot light generator mounted on said main body, said pilot light generator being comprised of a connection body and a head extending from said connection body, and an adjustment knob fastened to a pivoting rod which is pivoted with said main body of said adjustment control switch whereby said angle adjustment member is comprised of:

a connection main body provided in an interior with a gas duct and further comprised of a first connection end, a second connection end, and a third connection end;

a gas connection pipe connected at one end with said main burner and provided in an interior with a channel, said gas connection pipe being connected with said second connection end of said connection main body at a desired angle such that said channel of said gas connection pipe is in communication with said gas duct of said connection main body;

a pilot light adjustment rod comprised of a first rod body and a second rod body, which are connected with each other at an angle such that said first rod body is fastened to said third connection end of said connection main body; and a fastening frame fastened at one end to said first rod body of said pilot light adjustment rod, and at another end to said head of said pilot light generator of said adjustment control switch.

* * * * *